United States Patent [19]

Bulle et al.

[11] 4,269,026

[45] May 26, 1981

[54] CONNECTOR PIN FOR LINK BRACELETS

[75] Inventors: Marcel Bulle, Franois; Jean Vuillaume, Besancon, both of France

[73] Assignee: Timex Corporation, Waterbury, Conn.

[21] Appl. No.: 68,985

[22] Filed: Aug. 23, 1979

[51] Int. Cl.[3] ..... F16G 13/18

[52] U.S. Cl. ..... 59/82; 59/85

[58] Field of Search ..... 59/80, 82, 78, 84, 85; 74/254; 403/153, 154, 157

[56] References Cited

U.S. PATENT DOCUMENTS

| | | | |
|---|---|---|---|
| 1,721,100 | 7/1929 | Armstrong . | |
| 2,005,168 | 6/1935 | Rose . | |
| 2,251,169 | 7/1941 | Seal . | |
| 2,687,585 | 8/1954 | Launder . | |
| 2,780,830 | 2/1957 | Kammerer, Jr. | 74/254 X |
| 3,022,586 | 2/1962 | Towne . | |
| 3,047,318 | 7/1962 | Berkshire . | |
| 3,103,126 | 9/1963 | Textrom | 59/78 X |
| 3,175,314 | 3/1965 | Williamson | 74/254 X |
| 3,837,163 | 9/1974 | Fujimori | 59/80 |
| 4,050,323 | 9/1977 | I'Anson | 59/84 X |
| 4,089,161 | 5/1978 | Aoki | 59/80 |

FOREIGN PATENT DOCUMENTS 59167 10/1891 Fed. Rep. of Germany .

*Primary Examiner*—Howard N. Goldberg
*Attorney, Agent, or Firm*—Edward J. Timmer

[57] ABSTRACT

The invention provides an improved connector pin for use in connecting adjacent links of a bracelet, particularly a link watch band, together in releasable yet secure fashion so that one or more links can be readily removed with a simple cylindrical tool to adjust the length of the bracelet to the wrist size of the wearer. The connector pin is typically received in a transverse passage defined by coaxially aligned bores extending through adjacent links of the bracelet and includes an intermediate shaft adapted to be disposed in the transverse passage defined by the bores to provide an axis for relative rotation between adjacent links, thereby imparting flexibility to the bracelet so that it conforms to the wrist shape of the wearer, and an enlarged retaining head at opposite ends of the intermediate shaft with each retaining head being bifurcated so as to be compressible in size to enable removal of the connector pin simply by pushing one of the retaining heads through the transverse passage and out the outer side.

In a particularly preferred embodiment, the bores defining the transverse passage through adjacent links include enlarged end chambers which receive and conceal the enlarged, bifurcated retaining heads of the connector pin from view in a functionally and aesthetically advantageous manner.

2 Claims, 5 Drawing Figures

CONNECTOR PIN FOR LINK BRACELETS

FIELD OF THE INVENTION

The present invention is concerned with flexible link bracelets and, more particularly, with means for releasably connecting adjacent links together.

DESCRIPTION OF THE PRIOR ART

One type of flexible link bracelet widely used for wristwatch bands or jewelry bracelets includes individual links having a projecting tongue at one end and a groove at the other. To form the bracelet, the individual links are arranged in end-to-end relation with the tongue of one link received in the groove of the adjacent link to provide a plurality of tongue and groove joints along the length of the bracelet. In most cases, a connector pin is received in a transverse bore provided through the tongue and grooved ends of the adjacent links to provide an axis for relative rotation between adjacent links and to hold adjacent links together. In this way, the link bracelet is provided with sufficient flexibility to conform to wrist of the wearer. The connector pin may be an independent component, for example as shown in the Fujimori U.S. Pat. No. 3,837,163 issued Sept. 24, 1974 wherein each pin is cylindrical and held by interference fit with a bushing in the bore through each joint. Further, certain commercially available link bracelets utilize sheet metal screws threaded through the bore of each tongue and groove joint.

Alternatively, the connector pin may be formed integrally as part of the projecting tongue of each link, for example as illustrated in the Branchi U.S. Pat. No. 3,857,237 issued Dec. 31, 1974 and Hofman U.S. Pat. No. 3,604,203 issued Sept. 14, 1971.

Cylindrical connector pins have also been employed with link bracelets of the expansible type such as shown in the Vollet U.S. Pat. No. 3,017,682 issued Jan. 23, 1962 and with link bracelets having individual links which abut one another along the length of the bracelet such as illustrated in the Aoki U.S. Pat. No. 4,089,161 issued May 16, 1978.

SUMMARY OF THE INVENTION

According to the present invention, an improved connector pin is provided for use with link bracelets of the various types described above as well as others to connect adjacent links together in releasable and flexible fashion so that the bracelet can be easily adjusted in length and will conform to the wrist of the wearer. The connector pin may also find use in other hinge type structures such as for example the hinge of eyeglass frames.

Typically, the connector pin of the invention includes an intermediate shaft adapted to be positioned in the bore through adjacent links to provide an axis for relative rotation therebetween and an enlarged retaining head at opposite ends of the intermediate shaft with each retaining head being bifurcated to impart sufficient resiliency thereto to allow the connector pin to be withdrawn from or inserted into the bore by a simple pulling or pushing action with the retaining heads being compressed in size during withdrawal or insertion to enable passage through the bore. The connector pin is releasably held in the bore by the retaining heads which enlarge after passing through the bore. Preferably, the bore through adjacent links includes enlarged end chambers which receive and conceal the enlarged, bifurcated retaining heads of the connector pin. In a link watch band, the connector pin can be easily removed from the bore through each joint by pushing one of the enlarged, bifurcated retaining heads through the bore and out the other end with a simple cylindrical tool. This feature of the invention enables easy removal or addition of links to the band or bracelet for length adjustment purposes.

Therefore, it will be apparent that one object of the present invention is the provision of an improved connector pin which is easily removed or inserted to enable links to be added or removed to vary the length of the bracelet.

Another object of the invention is to provide a connector pin which can be easily removed or inserted with a simple tool by the purchaser of the bracelet, rather than a jeweler, and which is amenable to assembly by automated processes and equipment.

Still another object of the invention is to provide a lower cost connector pin and flexible link bracelet incorporating such pins for watch bands, jewelry or other uses.

BRIEF DESCRIPTION OF THE DRAWINGS

For a more complete understanding of the invention, reference is made to the following detailed description taken in connection with the accompanying drawings in which.

DESCRIPTION OF PREFERRED EMBODIMENTS

Figure 1:
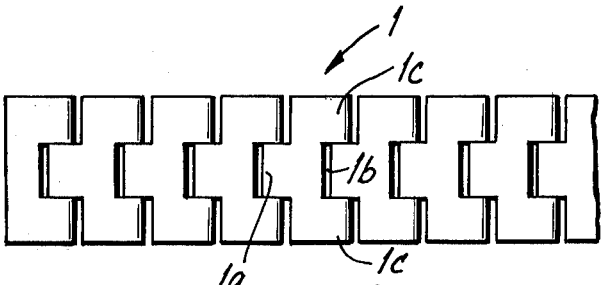
FIG. 1 is a plan view of a link watch band of the tongue and groove type.
Figure 2:
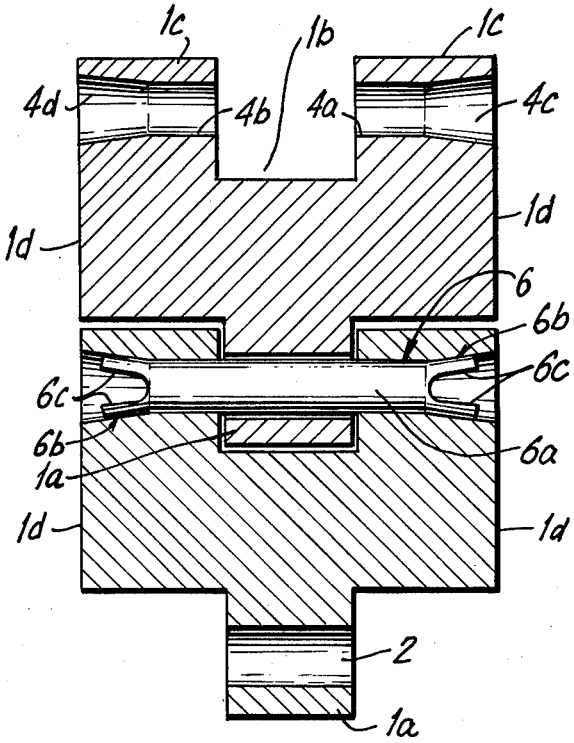
FIG. 2 is a cross-sectional view through adjacent links of the band of FIG. 1 showing the connector pin of the invention passing through the tongue and groove joint.

FIG. 1 illustrates a flexible, nonexpansible watch band of the tongue and groove type, i.e., each link 1 of the band includes a projecting tongue 1*a* at one end and a groove 1*b* at the other end defined by spaced lugs 1*c*. As shown, the links are arranged in end-to-end relation fo form the band with the tongue of one link being received in the groove of an adjacent link. FIG. 2 shows further features of the links, for example, a cylindrical bore 2 extending through each tongue transverse to the length of the band and first and second cylindrical bores 4*a* and 4*b* extending transversely through a portion of each spaced lug 1*c* with the outer portion of each bore being outwardly tapered to define enlarged truncated-conical end chambers 4*c* and 4*d* opening through the side walls 1*d* of each link. When adjacent links are juxtaposed in the tongue and groove arrangement, the tongue bore 2 is coaxially aligned with and between the first and second lug bores 4*a* and 4*b* and enlarged end chambers 4*c* and 4*d*. It is apparent that the coaxially aligned bores and end chambers provide a continuous passage with open ends through each tongue and groove joint of the band.

Figure 3:
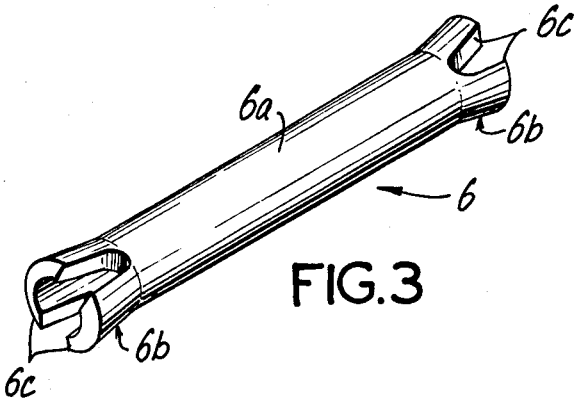
FIG. 3 is a perspective view of the connector pin of the invention.

Positioned in the continuous passage defined by aligned bores 2, 4*a* and 4*b* and end chambers 4*c* and 4*d* is the connector pin 6 of the invention. In FIGS. 2 and 3, the connector pin 6 is illustrated as including an intermediate shaft 6*a* and enlarged retaining heads 6*b* at opposite ends of the intermediate shaft, each of which retaining heads is bifurcated or split to define resilent retaining arms 6*c*. The intermediate shaft is preferably cylindrical in shape and is received in the coaxial cylindrical bores through the nested tongue 1*a* and lugs 1*c* of adjacent links. The diameter of the intermediate shaft is somewhat smaller than the diameter of the tongue bore 2 and preferably lug bores 4*a* and 4*b* so that adjacent links can rotate relative to one another to provide joint flexibility which enables the band to conform to the wrist of the wearer. In effect, the intermediate shaft 6*a* provides a hinge axis for relative rotational movement between adjacent links.

As shown, the enlarged, bifurcated retaining heads 6*b* are received in the corresponding enlarged end chambers 4*c* and 4*d* of the lug bores and function to hold the connector pins securely but releasably in the bores forming the passage through the tongue and groove joint. An especially important feature of the retaining heads is that each is bifurcated or split to provide multiple, resilent retaining arms 6*c* which are compressible in size to fit through the cylindrical lug and tongue bores and thereby allow the tongue and groove joints to be disassembled merely by pushing (or pulling) one of the retaining heads through the cylindrical bores and out the other side through the opposite enlarged end chamber. To facilitate removal of the connector pin in this manner, the retaining heads are preferably outwardly-tapered, truncated-conical in shape which permits gradual compression of the retaining arms 6*c* as they are forced into and through the cylindrical lug bore 4*a* or 4*b*. A significant advantage associated with the bifurcated retaining heads is that removal of the connector pin from the continuous passage through the tongue and groove joint can be effected easily by the wearer of the band with a simple cylindrical tool such as a suitably bent, wire paper clip of 0.8 to 1.0 mm diameter. The outward taper of the retaining heads is preferably about 14° so that the wire paper clip or other cylindrical tool is automatically guided into the corresponding tapered end chamber 4*c* or 4*d*. In this way, the length of the watch band or bracelet can be adjusted simply and easily to exactly suit the wrist of the wearer without the wearer having to seek out a skilled jeweler for such a service. Removal or addition of links can be accomplished with equal ease.

Figure 4:
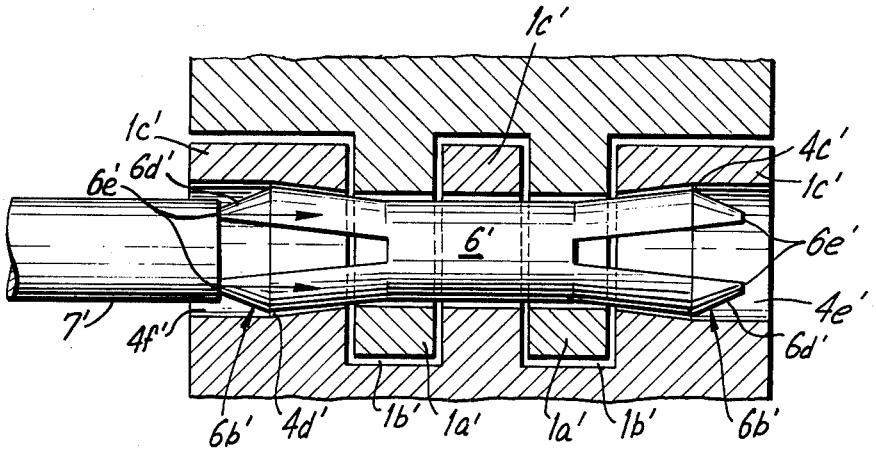
FIG. 4 is a cross-sectional view similar to FIG. 2 showing another preferred connector pin and a cylindrical tool engaged against one end of the pin.

FIG. 4 shows another version of a tongue and groove link watch band where one end of each link includes two spaced projecting tongues 1*a*′ and the other end includes two spaced grooves 1*b*′ defined by three spaced lugs 1*c*′. A cylindrical tool 7′ is shown engaged against one of the retaining leads 6*b*′ of a preferrred connector pin 6′ of the invention. It is apparent that the connector pin 6′ can be readily removed simply by pushing the tool 7′ axially into lug end chamber 4*d*′ against the retaining head. To facilitate engagement of the tool with the end of the connector pin, each retaining head 6*b*′ is provided with an inwardly tapered end 6*d*′ terminating in an annular engagement surface 6*e*′, the plane of which is substantially perpendicular to the long axis of the tongue and lug bores. In this embodiment, the outer lugs 1*c*′ each include an outwardly-tapered, truncated conical inner chamber 4*c*′, 4*d*′ and a cylindrical outer chamber 4*e*′, 4*f*′. As shown, the bifurcated retaining heads 6*b*′ extend partially into the cylindrical bores in the projecting tongues 1*a*′ of the adjacent link to further facilitate removal of the pin.

An advantage of the present invention is that the connector pins can be easily mass produced from metal or plastic by well known metal wire stamping or forging processes or well known plastic injection molding techniques. In addition, assembly of the adjacent links together and insertion of the connector pin into the continuous passage therethrough can be accomplished on mass production automated machinery. Problems associated with measuring and controlling torque for screw type connector pins is completely eliminated. Likewise, extra components such as bushings, or close tolerances such as involved in interference fits are essentially avoided with the connector pin of the invention.

Figure 5:
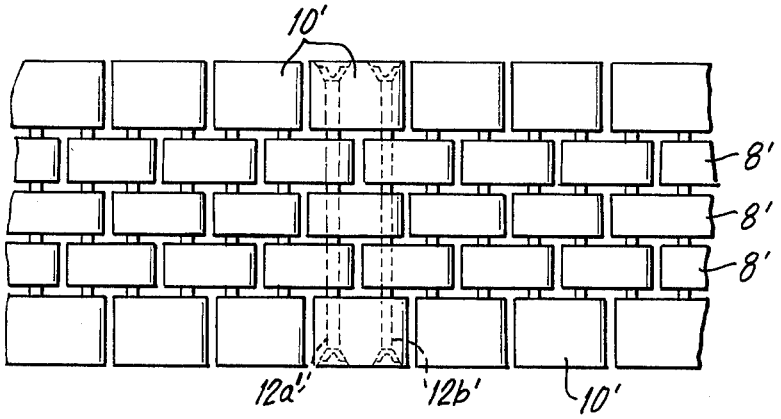
FIG. 5 is a plan view of another type of link watch band with adjacent links releasably connected together by pins of the invention.

Furthermore, the connector pin is not limited for use with only bands or bracelets of the tongue and groove type. Rather, it may be employed with a wide variety of constructions such as for example the band construction shown in FIG. 5 wherein smaller intermediate links 8′ are connected to larger outer links 10′ by two connector pins 12*a*′ and 12*b*′. In addition, the connector pin of the invention may find use in various miniature hinge structures such as those used in eyeglass frames where periodic replacement of components is required.

In the above detailed embodiments, the enlarged, bifurcated retaining heads were illustrated as received in corresponding enlarged chambers near opposite ends of the joint passage. Although this arrangement is preferred from the standpoint of aesthetics to conceal the enlarged retaining heads in the bores from the view of the wearer, it is not essential. In some situations, it may be aesthetically permissible to have the retaining heads extend outside the bore or passage through the joint, for example, past the opposite sidewalls 1*d* of the link fully visible to the wearer. Construction of the links should be simplified in this situation since the lug bores could take the form of simple cylindrical passages therethrough with no need for truncated-conical end chambers.

Furthermore, while the invention has been explained with respect to certain specific embodiments and modifications thereof, it will be understood that various other modifications and substitutions may be made without departing from the scope of the present invention.

We claim:

1. An improved flexible bracelet of the type having a plurality of links each with at least one projecting tongue at one end and spaced projecting lugs defining at least one groove at the other end, the links being arranged in end-to-end relation with the tongue of one link received in the groove of the adjacent link to provide a plurality of tongue and groove joints along the length of the bracelet, characterized in that:

(a) the tongue of each link includes a cylindrical bore extending transversely therethrough and the spaced lugs of each link each include an enlarged chamber outwardly tapered, truncated-conical in shape extending at least partially transversely therethrough in communication with said tongue bore in coaxial alignment therewith to define a transverse passage with open ends through each joint when the links are arranged end-to-end; and (b) a connector pin disposed in the transverse passage through each tongue and groove joint to hold adjacent links together in releasable yet secure fashion such that links can be readily removed from the bracelet for length adjustment purposes, said connector pin including an intermediate cylindrical shaft adapted to be disposed in the cylindrical bore of the tongue to provide an axis for relative rotation between adjacent links and also including an enlarged retaining head outwardly tapered, truncated-conical in shape at opposite ends of said intermediate shaft, said retaining heads each being received in a respective one of the enlarged lug chambers with each head being bifurcated so as to be compressible so that said connector pin can be easily removed from the passage through adjacent links simply by exerting axial force on one of said compressible retaining heads to force it into and through said passage and out the opposite end, thereby disengaging the adjacent links from one another.

2. An improved flexible bracelet of the type having a plurality of links each with at least one projecting tongue at one end and spaced projecting lugs defining at least one groove at the other end, the links being arranged in end-to-end relation with the tongue of one link received in the groove of the adjacent link to provide a plurality of tongue and groove joints along the length of the bracelet, characterized in that:

(a) the tongue of each link includes a cylindrical bore extending transversely therethrough and the spaced lugs of each link each include an inner enlarged chamber outwardly-tapered, truncated-conical in shape in communication with the tongue bore and an outer enlarged cylindrical chamber in communication with the inner chamber to define a transverse passage through each joint when the links are arranged end-to-end; and (b) a connector pin disposed in the transverse passage through each tongue and groove joint to hold adjacent links together in releasable yet secure fashion such that links can be readily removed from the bracelet for length adjustment purposes, said connector pin including an intermediate cylindrical shaft for positioning in the cylindrical bore of the tongue to provide an axis for relative rotation between adjacent links and also including an enlarged retaining head at opposite ends of said intermediate shaft, each retaining head comprising an inner portion outwardly-tapered, truncated-conical in shape to be received in said inner chamber of similar shape in the lugs and further comprising an outer portion inwardly-tapered, truncated-conical in shape to be received in said outer cylindrical chamber in the lugs and terminating in an annular engagement surface adapted to be contacted by a cylindrical tool inserted into said outer chamber for link separation purposes, each retaining head being bifurcated through both the inner and outer portions so as to be compressible to enable the connector pin to be easily removed by exerting axial force with said tool on the annular engagement surface to force the associated retaining head through and out of the passage, thereby disengaging the adjacent links from one another.

* * * * *